US006312032B1

(12) United States Patent
Richardson

(10) Patent No.: US 6,312,032 B1
(45) Date of Patent: Nov. 6, 2001

(54) CAN GRIP AND METHOD

(76) Inventor: Wayne R. Richardson, P.O. Box 661, Pleasant Garden, NC (US) 27313

( * ) Notice: Subject to any disclaimer, the term of this patent is extended or adjusted under 35 U.S.C. 154(b) by 0 days.

(21) Appl. No.: 09/507,643

(22) Filed: Feb. 22, 2000

(51) Int. Cl.[7] ..... B65D 71/00
(52) U.S. Cl. ..... 294/87.2; 294/33; 294/99.1
(58) Field of Search ..... 294/16, 27.1, 28, 294/31.1, 33, 34, 50.5, 87.1, 87.2, 87.22, 87.24, 87.26, 87.28, 99.1, 100, 115, 159; 53/247; 211/74

(56) References Cited

U.S. PATENT DOCUMENTS

| | | | | |
|---|---|---|---|---|
| 1,592,286 | * | 7/1926 | Rymarz | 294/28 |
| 1,631,598 | * | 6/1927 | Lehr | 294/28 |
| 2,138,498 | * | 11/1938 | McMillan | 294/87.24 |
| 2,140,314 | * | 12/1938 | Doscher | 294/87.24 |
| 2,441,494 | * | 5/1948 | Larmett et al. | 294/87.24 |
| 2,516,785 | * | 7/1950 | Mercer | 294/31.1 |
| 2,520,203 | * | 8/1950 | Haywa | 294/87.26 |
| 2,655,402 | * | 10/1953 | Johnson | 294/87.24 |
| 2,680,041 | * | 6/1954 | Gribskov et al. | 294/87.24 |
| 3,126,222 | * | 3/1964 | Stuart | 294/87.22 X |
| 4,545,608 | * | 10/1985 | Dodd | 294/87.1 |
| 4,889,245 | | 12/1989 | Rinke | 211/49.1 |
| 4,911,288 | | 3/1990 | Dantoin, Jr. | 206/139 |
| 5,551,565 | | 9/1996 | Kendrick | 206/427 |

FOREIGN PATENT DOCUMENTS

| | | | | |
|---|---|---|---|---|
| 707398 | * | 4/1954 | (GB) | 294/87.26 |

* cited by examiner

*Primary Examiner*—Johnny D. Cherry

(57) ABSTRACT

A grip is provided for grasping beverage cans for use in loading vending machines or the like. The can grip preferably grasps four cans at a time and a spring-loaded plunger ejects the cans therefrom when released. The method of employing the can grip provides for efficient stocking of vending machines and can reduce a serviceman's time by approximately sixty-five to seventy-five percent (65–75%) over usual hand loading.

9 Claims, 6 Drawing Sheets

CAN GRIP AND METHOD

FIELD OF THE INVENTION

The invention herein pertains to devices for manually grasping containers, and particularly pertains to a device for grasping a plurality of beverage cans from an open carton for use in loading a vending machine.

DESCRIPTION OF THE PRIOR ART AND OBJECTIVES OF THE INVENTION

Machines which dispense beverages in cans such as soft drinks, beer, tea, fruit juices and other products have become commonplace in recent years. These vending machines are often serviced on a daily basis to insure that ample beverages are present for public consumption. Servicemen usually transport cartons containing twenty-four cans by hand truck to the vending machine where the cartons are opened and the beverage cans are loaded into the vending machines, one at a time until the capacity of the vending machine is reached. Such hand loading is laborious and time consuming. However, beverage cans within vending machines are arranged in multiple rows and servicemen must often fill vending machines which are several rows wide and deep.

While many types of beverage can grasping devices have been developed in the past such as seen in U.S. Pat. Nos. 4,889,245; 4,911,288 and 5,551,565, such devices are generally not suitable for use in loading vending machines due to their size and configuration.

Thus, with the problems and disadvantages experienced with conventional can holding, handling devices and manual methods, the present invention was conceived and one of its objectives is to provide a manually operated can grip which can grasp a plurality of beverage cans simultaneously in linear alignment.

It is yet another objective of the present invention to provide a hand held can grip which allows the user to securely hold a series of beverage cans and which allows the user to selectively release the cans therefrom as needed.

It is a further objective of the present invention to provide a can grip which is narrow in width and which has relatively few moving parts for use in loading vending machines.

It is still a further objective of the present invention to provide a can grip and method of use to permit the device to easily fit within the spacial constraints of a vending machine for convenience in loading.

Various other objectives and advantages of the present invention will become apparent to those skilled in the art as a more detailed description is set forth below.

SUMMARY OF THE INVENTION

The aforesaid and other objectives are realized by providing a manually operable can grip and method of use for beverage cans such as when loading vending machines. The can grip includes a handle rigidly attached to an apertured frame member. A plunger is resiliently attached to the handle and includes a finger bar. Coil springs are located between the finger bar and the handle whereby manually squeezing the handle and finger bar with the user's hand causes ram members of the plunger to lift as the springs compress for subsequent spring release action and can ejection although manual force could be employed in lieu of springs, though such is not preferred. Beverage cans are urged through guides on the frame member into a gripped position where they are held by a series of distortable or flexible retainers within the frame member. Beverage cans are held in linear alignment for easy placement within the narrow constraints of a vending machine. Upon release of the plunger, the springs relax and expand thus driving the ram members past the can retainers to urge the cans into a selected location within the vending machine.

DETAILED DESCRIPTION OF THE PREFERRED EMBODIMENTS AND OPERATION OF THE INVENTION

Figure 1:
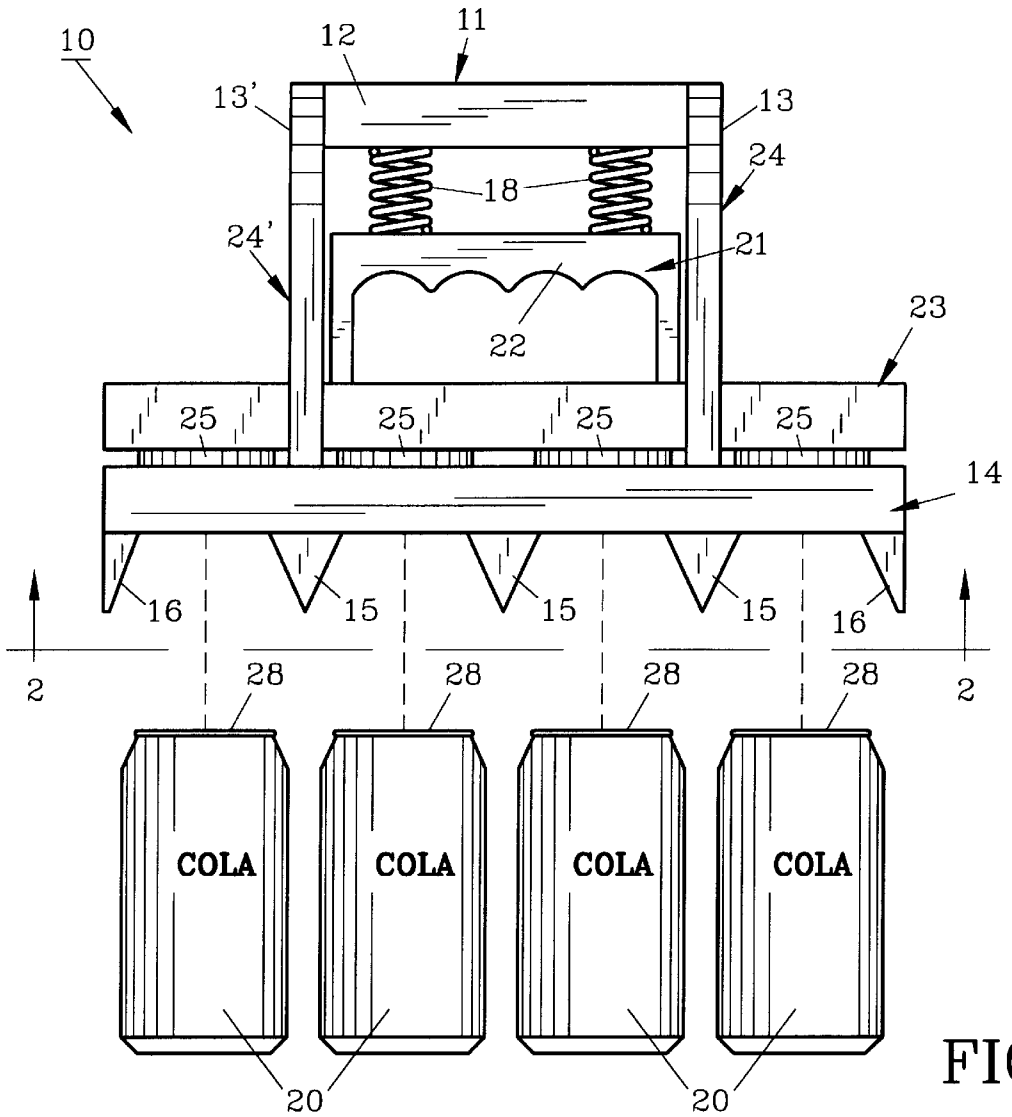
FIG. 1 illustrates the preferred form of the can grip of the invention for retaining four beverage cans simultaneously.
Figure 4:
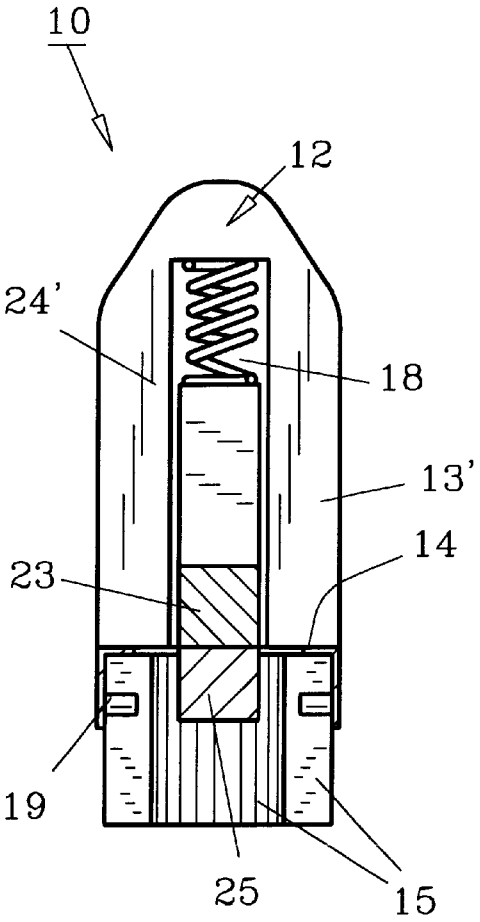
FIG. 4 features a view shown somewhat in cross section along lines 4—4 as seen in FIG. 2 with the springs relaxed.
Figure 2:
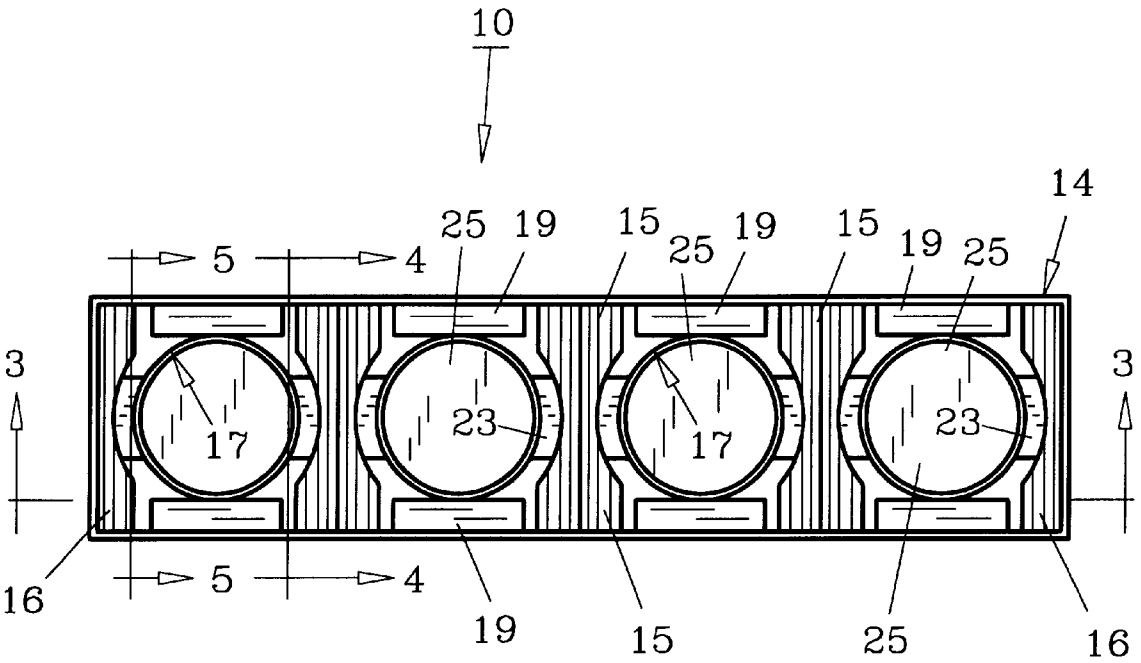
FIG. 2 shows a bottom view of the can grip as shown in FIG. 1 along lines 2—2.
Figure 3:
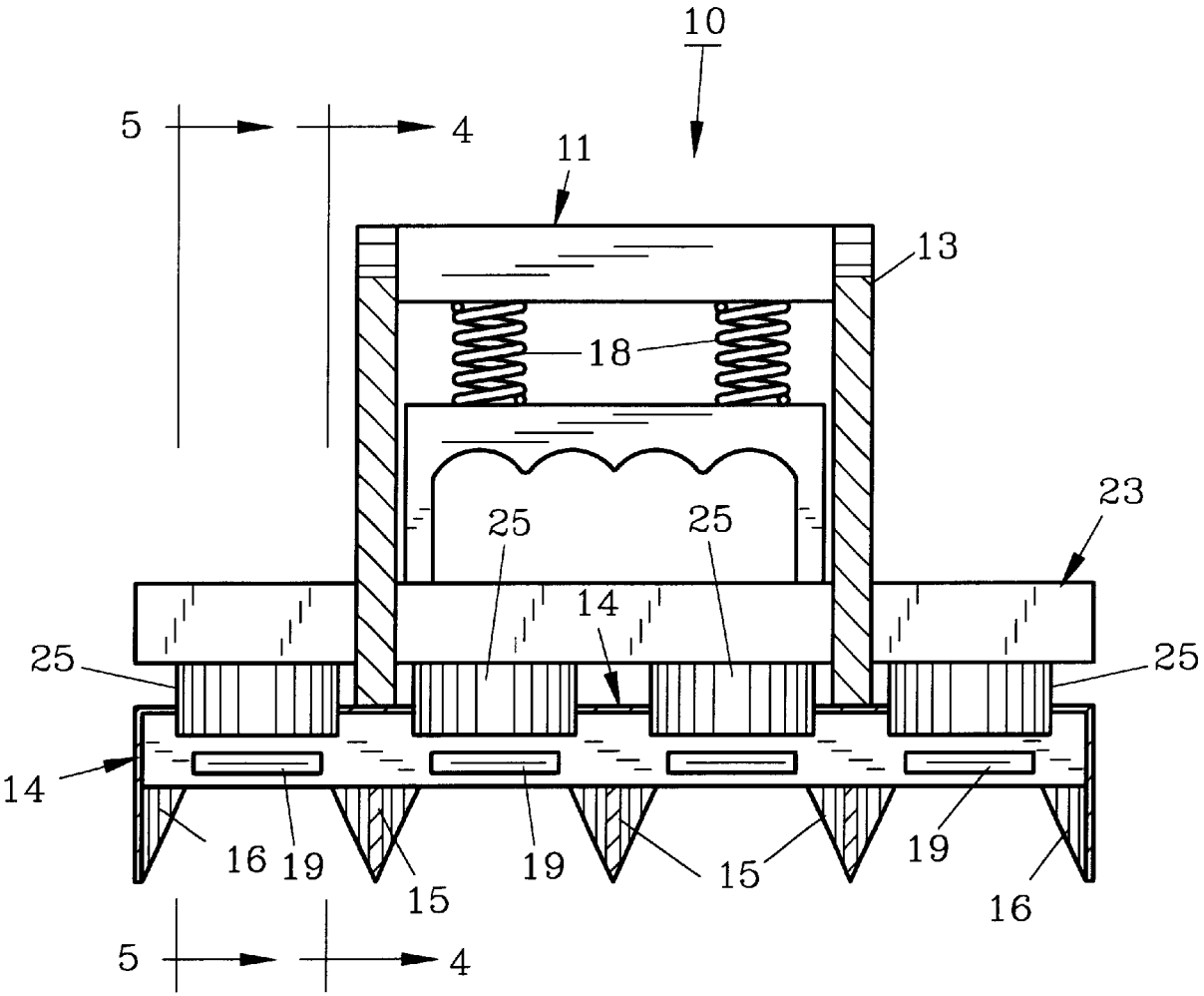
FIG. 3 demonstrates a partial cross-sectional view of the can grip generally along lines 3—3 of FIG. 2.

For a better understanding of the invention and its operation, turning now to the drawings, preferred can grip 10 as shown in FIGS. 1–4 includes handle 11 having a horizontal component 12 and vertical side members 13, 13'. Vertical members 13, 13' are rigidly attached to rectangular apertured frame member 14. Can guides 15, 16 are affixed to frame member 14 as shown in FIGS. 1, 2 and 3. Can guides 15 have pairs of opposing, somewhat funnel-like surfaces whereas can guides 16 have single, somewhat funnel-like surfaces (FIG. 2) to helpingly direct and guide cans 20 into frame member 14.

Plunger 21 also shown in FIG. 1 is resiliently mounted by springs 18 to handle 11. Springs 18 comprise a pair of metal coil springs although other resilient members or other types of springs could also be used. Plunger 21 includes finger bar 22 which is affixed to ram slide 23. Ram slide 23 is fitted within slots 24, 24' (FIG. 4) of respectively vertical members 13, 13'. Mounted to ram slide 23 are cylindrically shaped, solid ram members 25. Ram members 25 pass through circular apertures 17 of frame member 14 as shown in FIG. 2.

Figure 5:
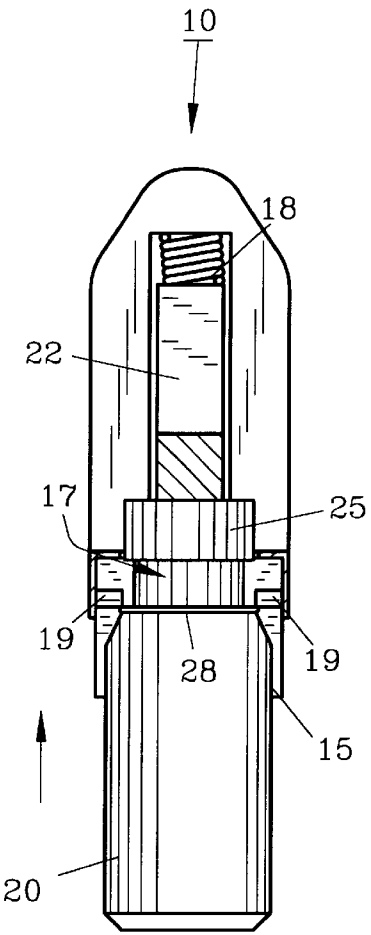
FIG. 5 depicts the initial step in placement of the can grip of FIG. 1 on a row of cans with the can lip contacting a can retainer.
Figure 6:
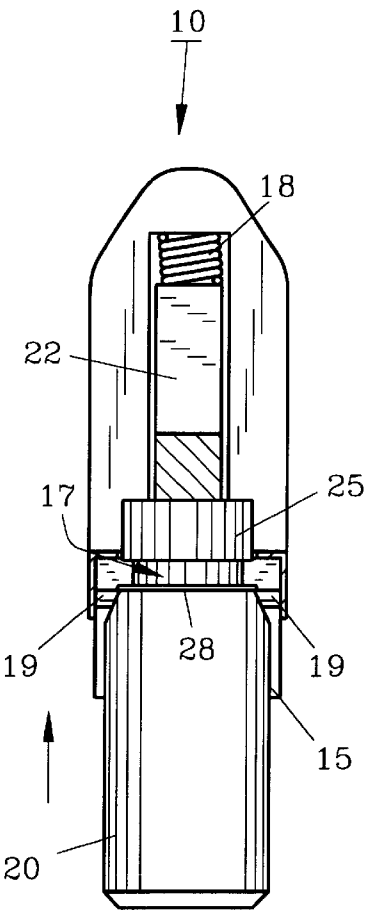
FIG. 6 pictures the can grip which has been forced against the can as seen in FIG. 5 with the retainer below the can lip.
Figure 7:
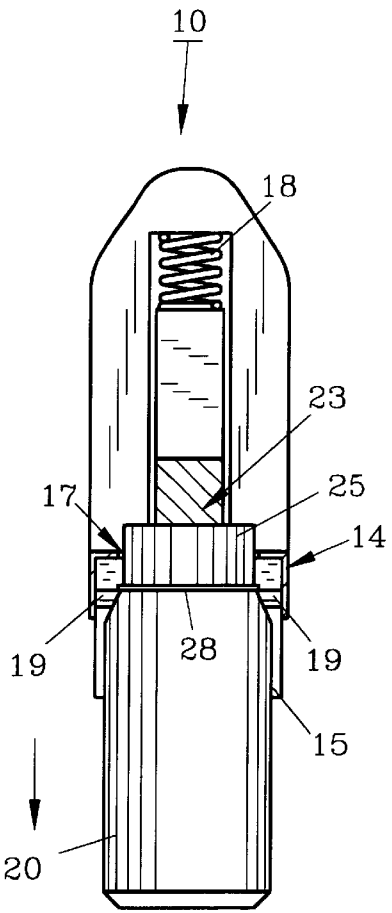
FIG. 7 illustrates the initial stage of releasing a can from the can grip as the ram member contacts the top of the can.
Figure 8:
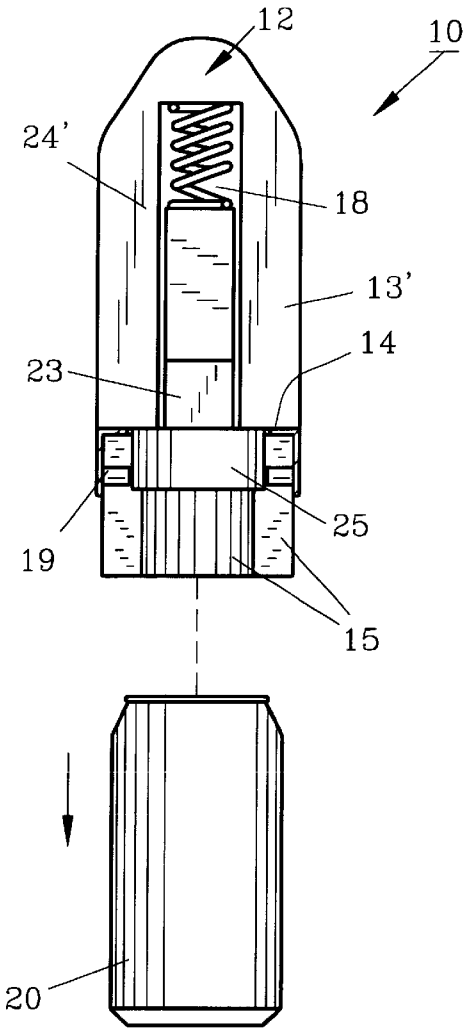
FIG. 8 shows the can fully driven from the can grip.

In use, when finger bar 22 is manually gripped tightly with horizontal handle member 12, springs 18 are compressed and ram members 25 are directed upwardly, as shown in FIGS. 5 and 6. When finger bar 21 is released (FIGS. 7 and 8), ram members 25 are thus driven downwardly by springs 18, forcing beverage cans 20 which are engaged by retainers 19, to be driven therefrom.

Can retainers 19 as shown in FIGS. 2 and 3 are mounted on frame member 14 on each side proximate apertures 17. Can retainers 19 are formed from a relatively hard but flexible polymeric material or other suitable material such as hard rubber so as to slightly flex and deform to allow can lip 28 as shown in FIGS. 5 and 6 to pass thereby when either manual pressure is applied upon grasping, or spring force is applied upon releasing cans 20.

While can grip 10 which may be formed from a suitable polymeric or other materials is shown with four ram members 25 for simultaneously operation or grasping of four beverage cans 20 (FIG. 1), similar devices could be constructed for a single can or for more than four cans, as desired.

Figure 9:
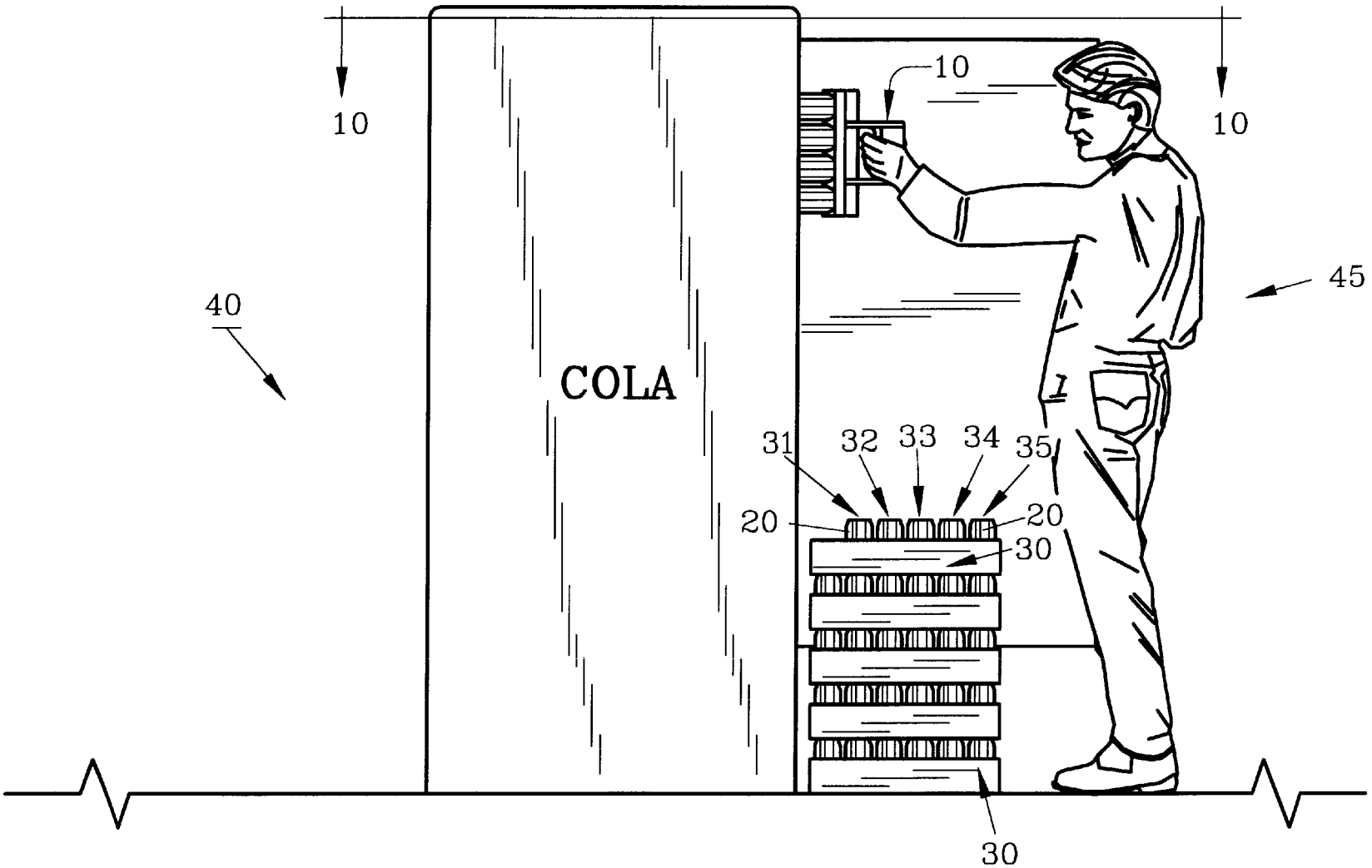
FIG. 9 demonstrates a typical serviceman loading a vending machine using the can grip of the invention.
Figure 10:
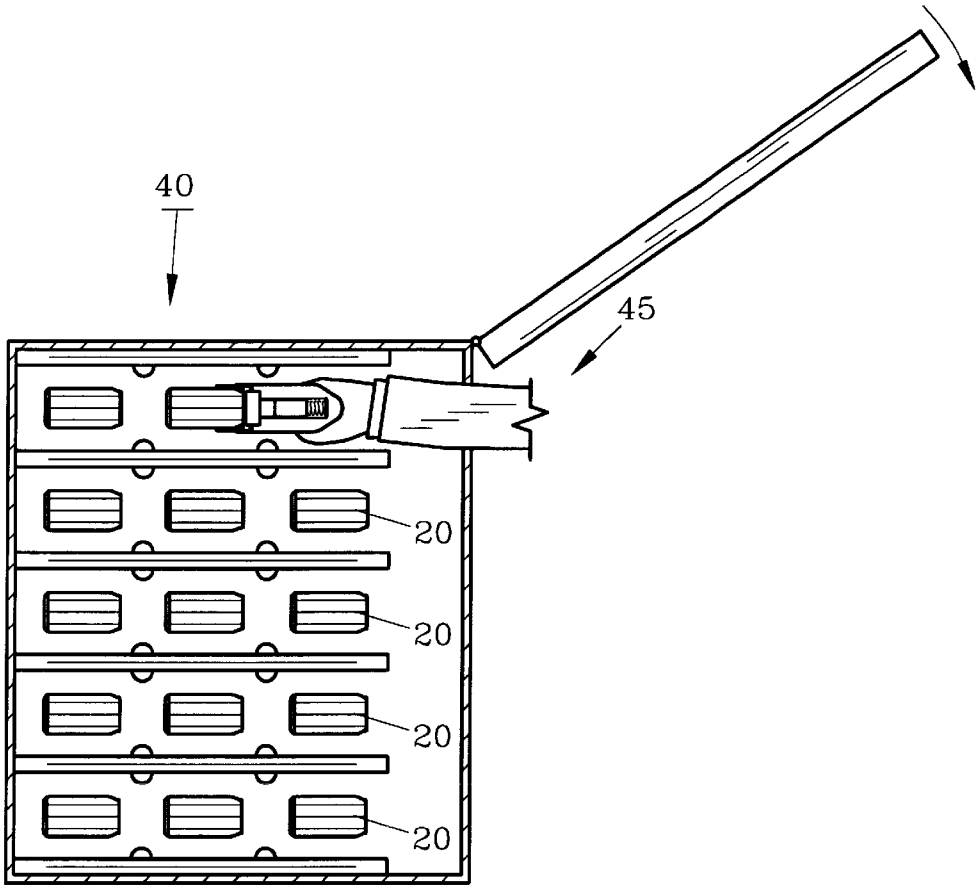
FIG. 10 depicts a top view of the vending machine generally along lines 10—10 of FIG. 9 illustrating the can grip within as the vending machine is being loaded.

Can grip 10 is used to conveniently and efficiently handle cans 20 and its preferred use is for loading vending machines as shown in FIGS. 9 and 10. Can grip 10 is placed, for example on row 31 of four beverage cans depicted in FIG. 9 in carton 30 which has been opened for can 20 exposure. By manually squeezing handle 11 and finger bar 22, plunger 21 is raised whereby ram members 25 are lifted past can retainers 19. Can grip 10 is next placed onto can row 31 and plunger 21 is held with springs 18 compressed. Can rows 32, 33, 341 35 are also shown in FIG. 9 in carton 30. Handle 11 is then urged downwardly, whereby can lips 28 move upwardly through can guides 15 and 16 as can retainers 19 distort and flex as shown in FIG. 6 to allow can lips 28 to pass by.

With can lips 28 positioned above retainers 19 (FIG. 6) can grip 10 is then lifted from carton 30 grasping four cans 20 as finger bar 22 and handle 11 remain tightly held with springs 18 compressed. Loaded can grip 10 is then placed into a typical vending machine such as vending machine 40 shown in FIG. 9 whereby serviceman 45 then directs loaded can grip 10 to a desired can column location as seen in FIG. 10. Finger bar 22 is then released and springs 18 drive plunger 21 with ram members 25 forwardly to release cans 20 as demonstrated in FIG. 8. Serviceman 45 then removes can grip 10 from vending machine 40 and grasps the next row 32 of cans as shown in FIG. 9 from carton 30 and vending machine 40 loading process is repeated until vending machine 40 is full.

As described, a typical carton 30 of twenty-four beverage cans 20 can be loaded in approximately twenty-five to thirty percent (25–30%) of the time normally required for hand loading.

The preferred method as hereinbefore described for a can grip with single can capacity (not shown) includes grasping a can 20 by placing ram member 25 against the top of can 20, urging handle 11 downwardly while springs 18 are compressed to thereby force retainer 19 past can lip 28 to grasp can 20. Thereafter, by releasing finger bar 22, springs 18 extend to drive ram member 25 outwardly, thereby forcing lip 28 of can 20 past retainer 19 to release the same.

The illustrations and examples provided herein are for explanatory purposes and are not intended to limit the scope of the appended claims.

I claim:

1. A can grip comprising: a handle, a frame, said handle attached to said frame, a spring-loaded plunger, said plunger attached to said handle, a can retainer, said retainer affixed to said frame, a can guide, said can guide defining a funnel-like surface, said can guide attached to said frame whereby a can held by said retainer can be released therefrom by said plunger.

2. The can grip of claim 1 formed from a polymeric material.

3. A can grip for supporting a plurality of beverage cans comprising:

a handle, a plunger, said plunger attached to said handle, a frame, said frame attached to said handle, a plurality of ram members, said ram members attached to said plunger and movable through apertures defined by said frame, a plurality of can retainers, said can retainers affixed to said frame proximate said apertures, a resilient member, said resilient member attached to said handle and said plunger whereby a plurality of beverage cans each engaged by different ones of said retainers can be driven therefrom by different ones of said ram members.

4. The can grip of claim 3 further comprising a plurality of can guides, said can guides attached to said frame.

5. The can grip of claim 3 herein said resilient member comprises a spring.

6. A method of grasping a can having a lip utilizing a can grip having a handle, a frame, a can retainer, a can guide, a plunger with a finger bar, and a ram member, comprising the steps of:

a) placing the can grip against the top of the can;

b) urging the handle downwardly to allow the can to move into the can guide, and c) forcing the retainer past the can lip to grasp the can.

7. The method of claim 6 and including the step of lifting the plunger by squeezing the finger bar while urging the handle downwardly.

8. The method of claim 6 wherein placing the retainer against the top of a can comprises the step of placing a plurality of retainers each against tops of different ones of a plurality of cans simultaneously.

9. The method of claim 6 further comprising the step of releasing the finger bar to drive the can from the can grip.

* * * * *